US008231507B2

(12) United States Patent
Munehiro

(10) Patent No.: US 8,231,507 B2
(45) Date of Patent: Jul. 31, 2012

(54) DEVICE FOR STRENGTHENING TONGUE MUSCLE

(76) Inventor: Motonori Munehiro, Hiroshima (JP)

( * ) Notice: Subject to any disclaimer, the term of this patent is extended or adjusted under 35 U.S.C. 154(b) by 0 days.

(21) Appl. No.: 12/693,212

(22) Filed: Jan. 25, 2010

(65) Prior Publication Data

US 2010/0184566 A1 Jul. 22, 2010

Related U.S. Application Data

(63) Continuation of application No. PCT/JP2008/001729, filed on Jul. 2, 2008.

(30) Foreign Application Priority Data

Jul. 26, 2007 (JP) ..... 2007-194120

(51) Int. Cl.
*A63B 21/00* (2006.01)

(52) U.S. Cl. ..... 482/11; 128/848

(58) Field of Classification Search ..... 128/848, 128/859; 482/11

See application file for complete search history.

(56) References Cited

U.S. PATENT DOCUMENTS

| | | | | |
|---|---|---|---|---|
| 2,643,652 | A * | 6/1953 | Cathcart | 128/861 |
| 3,187,746 | A | 6/1965 | Gerber | |
| 4,997,182 | A | 3/1991 | Kussick | |
| 5,467,783 | A | 11/1995 | Meade | |
| 5,592,951 | A | 1/1997 | Castagnaro et al. | |
| 7,861,722 | B2 * | 1/2011 | Keropian | 128/848 |

FOREIGN PATENT DOCUMENTS

JP 2006-288953 A 10/2006

OTHER PUBLICATIONS

International Search Report (ISR) for PCT/JP2008/001729 for Examiner consideration.
Written Opinion (PCT/ISA/237) of PCT/JP2008/001729.

* cited by examiner

*Primary Examiner* — Jerome W Donnelly
(74) *Attorney, Agent, or Firm* — Chen Yoshimura LLP

(57) ABSTRACT

To provide a tongue muscle-strengthening device which can prevent or recover a poor posture that is attributed to no development of lingual adhesion in the mandible to the skull due to the decreased function of tongue muscles, stress-induced disorder that is attributed to the hyperfunction of the masticatory muscle group and tongue muscles in the cerebral cortex motor area, as well as the dysfunction and an aesthetic impairment of the mouth and which can actualize lingual adhesion. The tongue muscle-strengthening device in the invention of this application is composed of the part of maxillary teeth contact that is in contact with the maxillary teeth, the parts of dorsum of tongue and palate contact that are respectively in contact with the dorsum of tongue and palate, as well as the part of connection that connects the part of maxillary teeth contact with the parts of dorsum of tongue and palate contact. The user brings the part of palate contact into contact with the palate by inserting the part of maxillary teeth contact into the maxillary teeth, by bringing the part of dorsum of tongue contact into contact with the dorsum of tongue, by bringing the lingual apex into contact with the part of lingual apex contact, and by elevating the dorsum of tongue, and maintains the condition for a while. The elasticity of the part of connection places a sustained and strong burden on tongue muscles and strengthens tongue muscles. Furthermore, the tongue muscle-strengthening device in the invention of this application has good usability because it is an intraoral device.

10 Claims, 7 Drawing Sheets

DEVICE FOR STRENGTHENING TONGUE MUSCLE

CROSS REFERENCE TO RELATED APPLICATION

This is a continuation application of PCT/JP2008/001729 filed on Jul. 2, 2008 which claims priority from a Japanese Patent Application No. 2007-194120 filed on Jul. 26, 2007, the contents of which are incorporated herein by reference.

BACKGROUND

1. Technical Field

This invention is related to a tongue muscle-strengthening device. The dorsum of tongue does not broadly adhere to the palate through saliva in the rest position due to the weakening of the saliva-mediated adhesion force which is produced between the palate and the dorsum of tongue especially caused by the decreased elevating force of tongue muscles that is present in the oral cavity or to no production of the adhesive force caused by the insufficient elevation of tongue muscles, resulting in no generation of the role of the tongue as an adhesive pad that suspends the mandible to the skull, so-called lingual adhesion. The instability of the mandible to the skull leads to the instability of the head and neck, the instability of the head and neck causes a poor posture, and the instability of the mandible to the skull causes stress-induced disorder associated with the hyperfunction of the masticatory muscle group and tongue muscles in the cervical cortex motor area, as well as the dysfunction and an aesthetic impairment of the mouth. This invention is related to a tongue muscle-strengthening device to actualize this lingual adhesion.

Furthermore, tongue muscles are largely involved in mastication, deglutition and pronunciation, and this invention is related to a tongue muscle-strengthening device for improving these functions.

2. Related Art

In the condition of normal mouth, the following are known in general: the lingual apex is in contact with the maxillary incisive papilla; the dorsum of tongue adheres to the palate; the lips of mouth are closed; and the teeth of the maxilla and mandible are not in contact.

Tongue muscles play an important role in the abovementioned normal mouth. Namely, the tongue functions as an adhesive pad that suspends the mandible to the skull by the broad adhesion of the dorsum of tongue to the palate through saliva, and this lingual adhesion allows the stable suspension of the mandible to the skull without the contraction of masticatory muscles.

The abovementioned condition of stable suspension is a condition in which masticatory muscles that are attached to the mandible show no muscular activity, and the balance of forces in the head and neck occurs centrally to the spinal cord which passes through the great foramen of the skull. Namely, the posture of the head and neck stabilizes against gravidity. The posture of the trunk stabilizes against gravidity in association with it. The mandible stabilizes against gravidity due to this lingual adhesion, which suppresses the hyperfunction of the masticatory muscle group and tongue muscles in the cerebral cortex motor area. Muscular activity is a great stress for the body because it is processed based on information out of the brain. Furthermore, the abovementioned lingual adhesion causes a great reduction in stress for the body because the neurons governing the masticatory muscle group and tongue muscles occupy the large percentage of the cerebral cortex motor area. Tongue muscles require a potent elevating force in this lingual adhesion.

The abovementioned lingual adhesion makes the mouth less prone to open during sleep by minimizing the muscular activity of the orbicular muscles of mouth when closing the mouth and hampers the sinking of the root of tongue into the upper airway during sleep. Therefore, the abovementioned lingual adhesion recovers and prevents sleep apnea syndrome and disorders associated with it.

Furthermore, tongue muscles play an important role in eating activity. Namely, tongue muscles play important roles in all activities of food capture, mastication and deglutition. Especially in the activity of deglutition, tongue muscles form in the palate a food mass which is easily degluted by placing masticated food onto the dorsum of tongue and by elevating the dorsum of tongue and then perform a smooth degluting activity by pressing the dorsum of tongue against the palate at a burst. Tongue muscles require a potent elevating force in this activity of deglutition.

Furthermore, tongue muscles play an important role in expanding the maxillary dental arch. The insufficient expansion of the maxillary dental arch is known as one of the causes for the bad teeth alignment. Namely, the maxillary dental arch is expanded by the application of a potent elevating force laterally to the maxillary teeth row which tongue muscles are in contact at the time of deglutition activity.

The nasal cavities facing the maxillary dental arch also expand simultaneously, which is known to be effective for improving nasal respiration.

Furthermore, tongue muscles play an important role in communications. Namely, tongue muscles are indispensable for pronunciation. Smooth pronunciation is performed by the pliable activity of tongue muscles.

Among dysarthrias, those in the row "ta"—voiceless alveolar plosions among alveolars and those in the row "ra"—alveolar approximants are observed frequently.

Tongue muscles require a potent elevating force in the pronunciation of both the rows "ta" and "ra".

Especially, dysarthria in the row "ta" is caused by the insufficient elevating force of tongue muscles, and the row "ta" is pronounced by compensatorily inserting the tongue into a space between the maxillary anterior teeth and the mandibular anterior teeth.

In the abovementioned case of dysarthria, so-called open bite occurs because pronunciation is performed by inserting the tongue into a space between the maxillary anterior teeth and the mandibular anterior teeth.

Furthermore, teeth clenching, teeth gnashing and a habit of oral respiration with the constantly open mouth are known to worsen teeth alignment.

Like the invention described in Japanese published unexamined application No. 2006-288953, a device which concurrently strengthens the orbicular muscles of mouth and tongue muscles has been present previously.

The invention described in patent reference 1 concurrently strengthens the orbicular muscles of mouth and tongue muscles. However, the invention was insufficient in strengthening tongue muscles because tongue muscles require a very potent muscular force and the sources of fixation for muscular force in the invention described in patent reference 1 are the orbicular muscles of mouth and anterior teeth. Furthermore, the area of contact of the tongue support piece in the invention described in patent reference 1 occupies a small area in the entire dorsum of tongue. Therefore, the invention was insufficient in strengthening tongue muscles. Furthermore, many devices of the invention described in patent reference 1 were placed out of the oral cavity, and the invention was insufficient in strengthening tongue muscles due to restrictions in place of use, setting time and frequency of use.

Hence, this invention intends to resolve the abovementioned problems. The saliva-mediated adhesive force which is generated between the palate and the dorsum of tongue is strengthened by intensifying the elevating force of tongue muscles through the long-term placement of a strong stable burden on the dorsum of tongue, the dorsum of tongue becomes an adhesive pad for the maxilla in the rest position, and the mandible is suspended to the skull. This invention intends to prevent or recover a poor posture, stress-induced disorder caused by the hyperfunction of the masticatory muscle group and tongue muscles in the cerebral cortex motor area, as well as the dysfunction and an aesthetic impairment of the mouth by means of this lingual adhesion.

Furthermore, this invention is easy to set because it is an intraoral device whose source of fixation is sought in the maxillary teeth row, and allows long-term use and provides good usability.

SUMMARY

Therefore, it is an object of the present invention to provide a tongue muscle-strengthening device, which is capable of overcoming the above drawbacks accompanying the conventional art. The above and other objects can be achieved by combinations described in the independent claims. The dependent claims define further advantageous and exemplary combinations of the present invention.

According to one aspect of an exemplary of (selected from an apparatus, an method, a system, a device, an article and so on) relating to the innovation contained in the present specification, the present invention, the tongue muscle-strengthening device in the invention of this application is composed of the part of maxillary teeth contact that is in contact with maxillary teeth, the parts of dorsum of tongue and palate contact that are respectively in contact with the dorsum of tongue and the palate, the part of lingual apex contact that is in contact with the lingual apex, as well as the elastic part of connection that connects the part of maxillary teeth contact with the parts of dorsum of tongue and palate contact.

The tongue muscle-strengthening device in the invention of this application can place an appropriate burden on the dorsum of tongue by using the elasticity that the part of connection has while using the part of maxillary teeth contact and the part of mandibular teeth contact as the sources of fixation and can simply and efficaciously strengthen the tongue muscles-elevating force.

The summary of the invention does not necessarily describe all necessary features of the present invention. The present invention may also be a sub-combination of the features described above.

DESCRIPTION OF EXEMPLARY EMBODIMENTS

Figure 1:
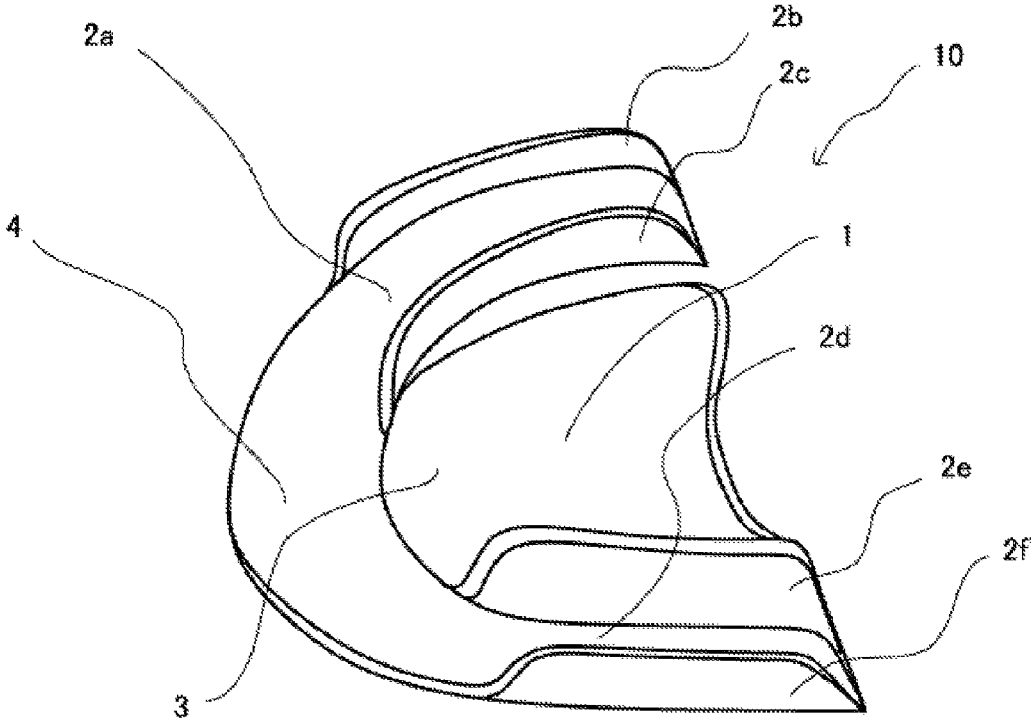
FIG. 1 is a perspective view of the tongue muscle-strengthening device which is related to Example 1 of this invention.

The one aspect of the invention will now be described based on the preferred embodiments, which do not intend to limit the scope of the present invention, but exemplify the invention. All of the features and the combinations thereof described in the embodiment are not necessarily essential to the invention.

The tongue muscle-strengthening device which is related to the mode of performing this invention 10 has, as shown in FIGS. 1 to 7, the part of maxillary teeth contact 2 and the part of maxillary anterior teeth contact 4 which can be set to the maxillary teeth, the part of dorsum of tongue contact 5 that is in contact with the dorsum of contact 23, the part of palate contact 1 that is in contact with the palate 9, and the part of connection 3 which connects them.

EXAMPLE 1

FIGS. 1 to 6 show the tongue muscle-strengthening device 10 which is related to Example 1.

The tongue muscle-strengthening device 10 which is related to this example 1 is composed of the part of maxillary teeth contact 2 and the part of maxillary anterior teeth contact 4 which can be set to the maxillary teeth as shown in FIG. 1, the part of dorsum of tongue contact 5 that is in contact with the dorsum of tongue 23, the part of palate contact that is in contact with the palate 9, as well as the part of connection 3 which connects these parts.

FIG. 1 is the perspective view of the tongue muscle-strengthening device which is related to Example 1 of this invention. As shown in FIG. 1, the part of maxillary teeth contact is composed of the part of right maxillary teeth occlusion contact 2*a*, the part of right maxillary teeth cheek side contact 2*b*, the part of right maxillary teeth tongue side contact 2*c*, the part of left maxillary teeth occlusion contact 2*d*, the part of left maxillary teeth tongue side contact 2*e* and the part of left maxillary teeth cheek side contact 2*f*, strengthens tongue muscles 24 by becoming a robust source of fixation for the part of palate contact 1 when elevating tongue muscles 24 and contributes to the expansion of the maxillary dental arch by the application of a force laterally to the maxillary teeth row which tongue muscles are in contact when elevating tongue muscles 24 and consequently to the resulting expansion of palate bones 22.

As shown in FIG. 1, the part of connection 3 connects the part of palate connection 1 and the part of maxillary teeth contact 2 obliquely downward to the occlusion plane in order that an appropriate burden is placed on tongue muscles 24 when elevating tongue muscles 24.

As shown in FIG. 1, the part of maxillary anterior teeth contact 4 does not cover the lip side of the maxillary anterior teeth 21 in order that the force of the orbicular muscles of mouth is applied to the maxillary anterior teeth when elevating tongue muscles 24.

As shown in FIG. 1, the part of palate contact 1 has a form convexed upward in order to make the deformation of palate bones 22 less likely to occur when elevating tongue muscles 24.

Figure 2:
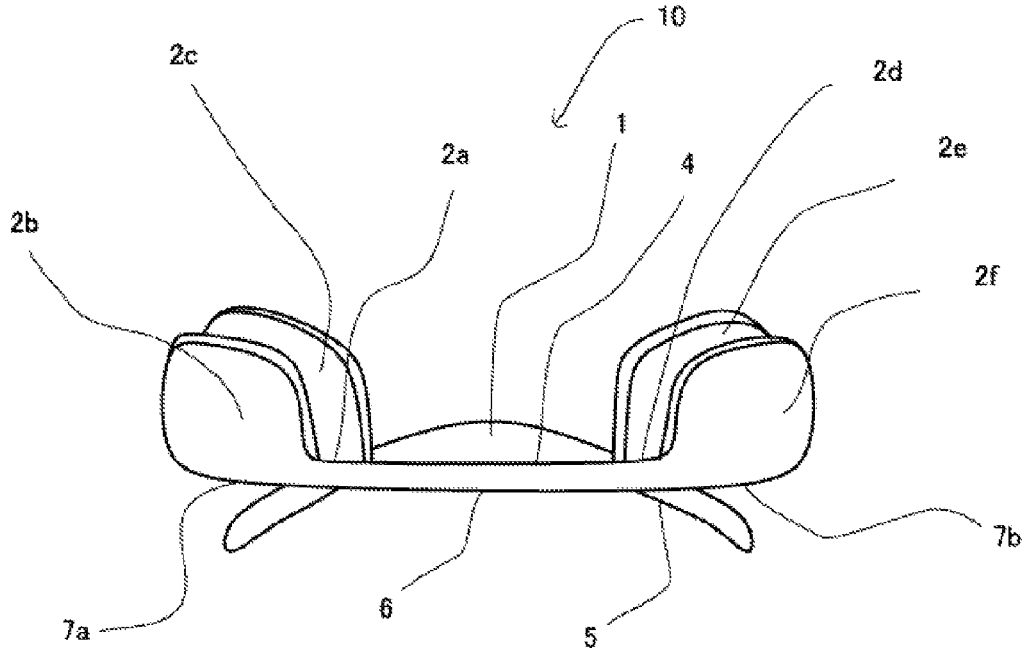
FIG. 2 is a front view of the tongue muscle-strengthening device which is related to Example 1 of this invention.

FIG. 2 is the front view of the tongue muscle-strengthening device which is related to Example 1 of this invention. As shown in FIG. 2, the part of maxillary anterior teeth contact 4 does not cover the tongue side of the maxillary anterior teeth 21 in order that the part of palate contact 1 applies an appropriate force to the tongue side of the maxillary anterior teeth 21 when elevating tongue muscles 24.

Figure 3:
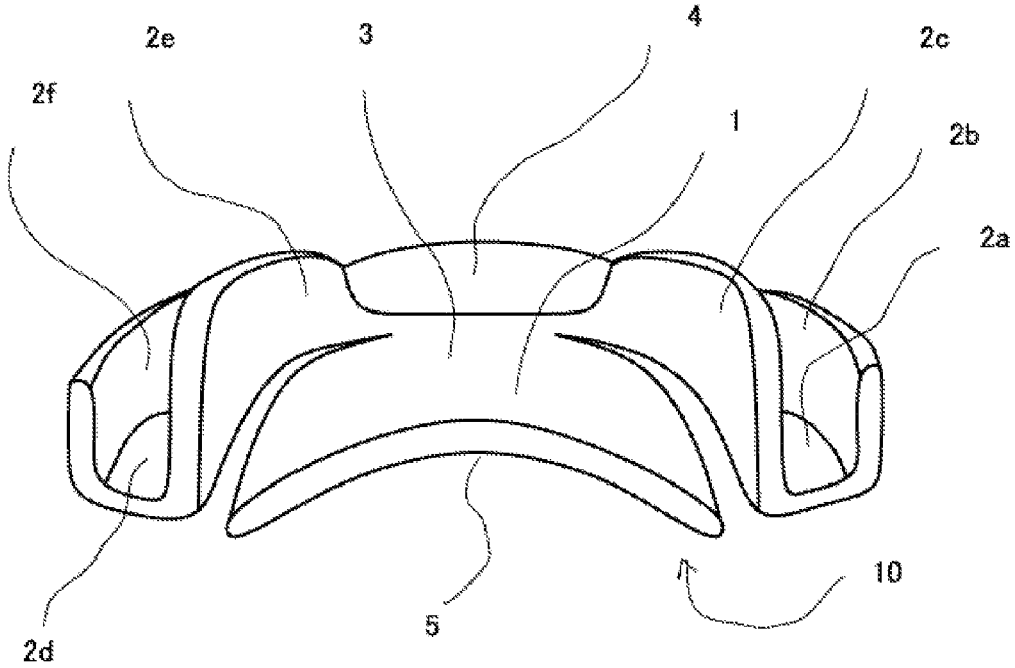
FIG. 3 is a rear view of the tongue muscle-strengthening device which is related to Example 1 of this invention.

FIG. 3 is the rear view of the tongue muscle-strengthening device which is related to Example 1 of this invention and is composed to cover the entirety of the palate 9 with the part of palate contact 1, the part of right maxillary teeth tongue side contact 2*c* and the part of left maxillary teeth tongue side contact 2*e* when elevating tongue muscles 24.

As shown in FIG. 3, the part of dorsum of tongue contact 5 has a form convexed upward in order that a sufficient force is applied to tongue muscles 24 when elevating tongue muscles 24.

Figure 4:
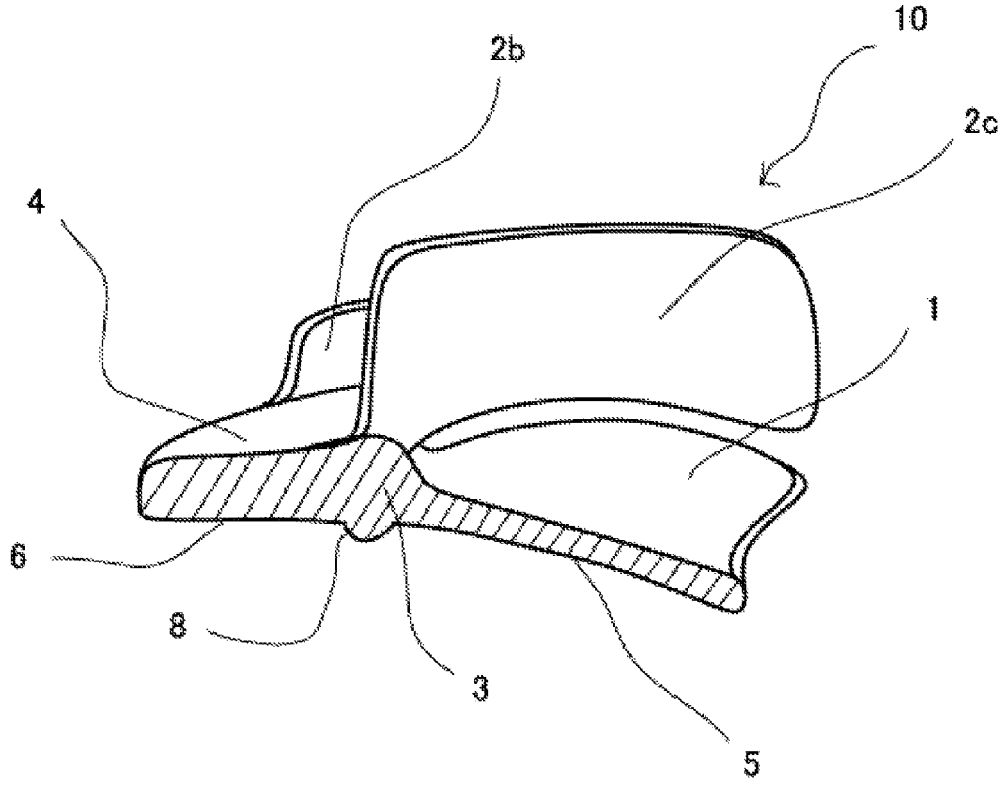
FIG. 4 is a section view of the tongue muscle-strengthening device which is related to Example 1 of this invention.

FIG. 4 is the section view of the tongue muscle-strengthening device which is related to Example 1 of this invention and has the part of lingual apex contact 8 in order that the lingual apex 25 can be in contact with the site which corresponds to maxillary incisive papilla 32 when elevating tongue muscles 24.

Figure 5:
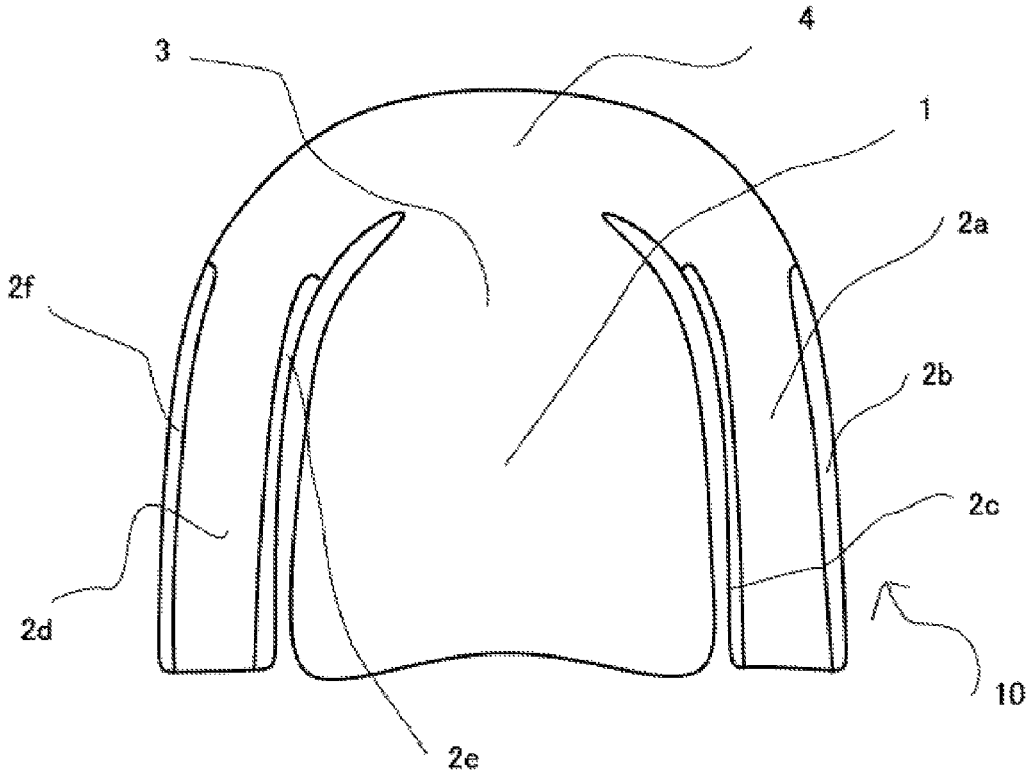
FIG. 5 is a top view of the tongue muscle-strengthening device which is related to Example 1 of this invention.

FIG. 5 is the top view of the tongue muscle-strengthening device which is related to Example 1 of this invention. As shown in FIG. 5, the part of palate contact 1 has a large area in order that a sufficient force is applied to palate bones 22 when elevating tongue muscles 24.

Figure 6:
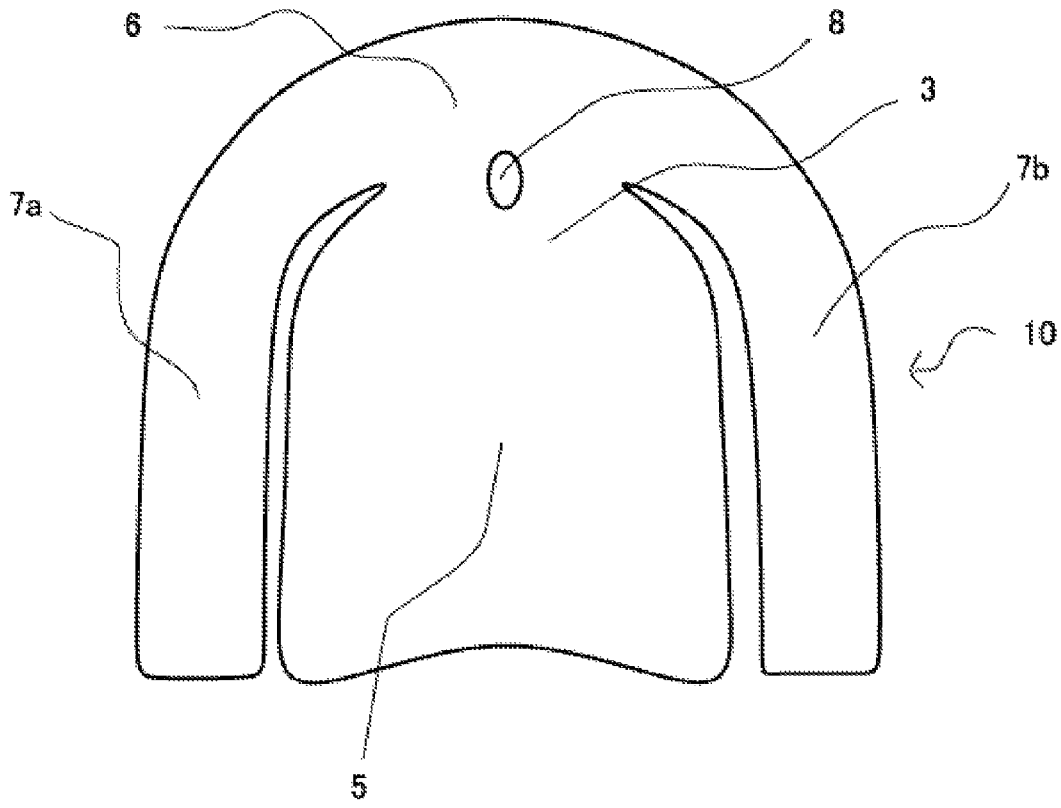
FIG. 6 is a bottom view of the tongue muscle-strengthening device which is related to Example 1 of this invention.

FIG. 6 is the bottom view of the tongue muscle-strengthening device which is related to Example 1 of this invention. As shown in FIG. 6, the part of dorsum of tongue contact 5 has a large area in order that a sufficient force is applied to tongue muscles 24 when elevating tongue muscles 24.

Figure 7:
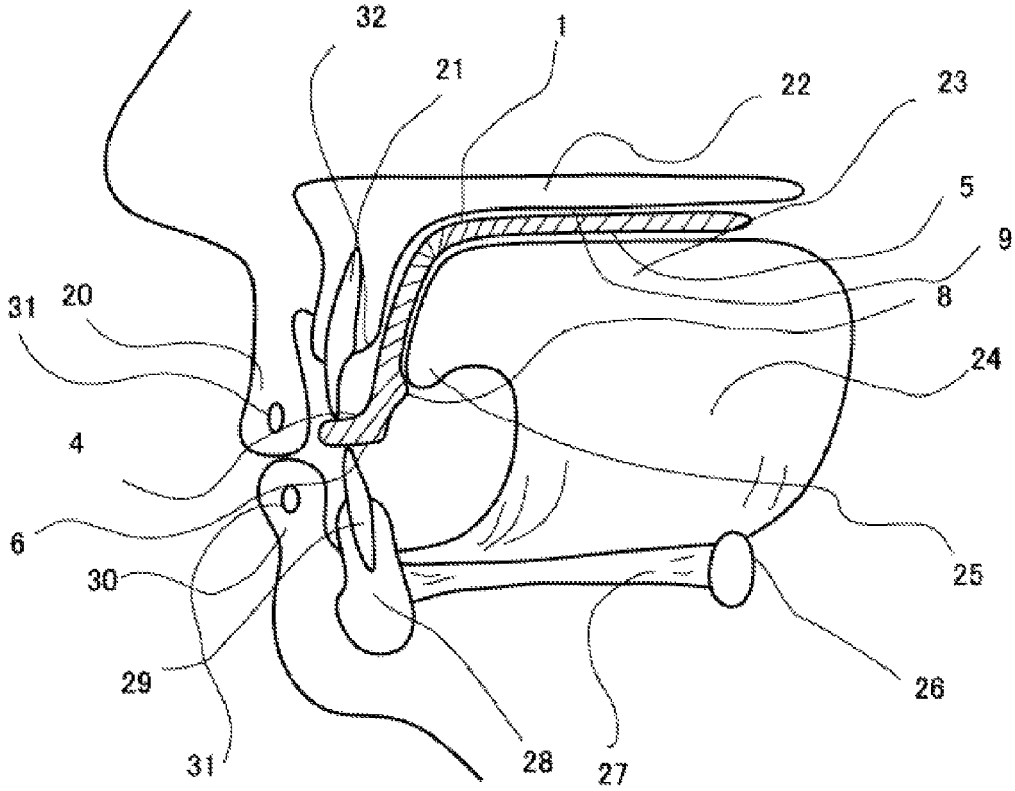
FIG. 7 is a section view which shows a condition of setting to the mouth the tongue muscle-strengthening device which is related to Example 1 of this invention.

FIG. 7 is the section view which shows a condition in which the tongue muscle-strengthening device that is related to Example 1 of this invention is set in the oral cavity. As shown in FIG. 7, the tongue muscle-strengthening device 10 is an intraoral device that has better usability, that presents longer setting time and that is readily effective compared to a previous tongue muscle-strengthening device, an extraoral device.

As shown in FIG. 7, the tongue muscle-strengthening device 10 indirectly contributes to the strengthening of the orbicular muscles of mouth 31.

As shown in FIG. 7, the natural elevating force of tongue muscles 24 appears also when not setting the tongue muscle-strengthening device 10, and the tongue functions as an adhesive pad which suspends the mandible 28 to the skull by the broad adhesion of the dorsum of tongue 23 to the palate 9 through saliva. This lingual adhesion allows the stable suspension of the mandible 28 to the skull, the improvement of posture, and the reduction of stress even when masticatory muscles do not contract and can reduce stress.

Although the one aspect of the present invention has been described by way of exemplary embodiments, it should be understood that those skilled in the art might make many changes and substitutions without departing from the spirit and the scope of the present invention which is defined only by the appended claims.

The operations, the processes, the steps, or the like in the apparatus, the system, the program, and the method described in the claims, the specification, and the drawings are not necessarily performed in the described order. The operations, the processes, the steps, or the like can be performed in an arbitrary order, unless the output of the former-described processing is used in the later processing. Even when expressions such as "First," or "Next," or the like are used to explain the operational flow in the claims, the specification, or the drawings, they are intended to facilitate the understanding of the invention, and are never intended to show that the described order is mandatory.

As apparent from the above disclosure, according to the embodiment(s) of the invention, since the tongue muscle-strengthening device in the invention of this application has the part of dorsum of tongue contact, the repeated acts of elevating the tongue generates the function of an adhesive pad that broadly adheres the dorsum of tongue to the palate through saliva. This lingual adhesion allows the suspension of the mandible to the skull. This lingual adhesion is a condition in which there is no contraction of masticatory muscles that are attached to the mandible and the balance of forces in the head and neck occurs centrally to the spinal cord that passes through the great foramen of the skull. Namely, the posture of the head and neck stabilizes against gravidity. The posture of the trunk stabilizes in association with it. Namely, posture can be improved.

Since the tongue muscle-strengthening device in the embodiment(s) of the invention of this application has the part of dorsum of tongue contact, the repeated acts of elevating the tongue generates the function of an adhesive pad that broadly adheres the dorsum of tongue to the palate through saliva. This lingual adhesion is a condition in which there is no contraction of masticatory muscles that are attached to the mandible. The efferent neurotransmission from the cerebral cortex is the activity of outputs from the cerebral cortex. Physiologically and anatomically, furthermore, the neurons governing the masticatory muscle group and tongue muscles occupy the large percentage in the cerebral cortex motor area. Therefore, this lingual adhesion extensively reduces stress to the body.

The abovementioned lingual adhesion makes the mouth less prone to open during sleep by minimizing the muscular activity of the orbicular muscles of mouth when closing the mouth and hampers the sinking of the root of tongue into the upper airway during sleep. Therefore, the abovementioned lingual adhesion recovers and prevents sleep apnea syndrome and disorders associated with it.

In general, the insufficient elevation of tongue muscles is known as the cause for aspiration.

The tongue muscle-strengthening device in the embodiment(s) of the invention of this application has the part that can place a burden on tongue muscles when performing the act of elevating the tongue, and tongue muscles hence elevate against the abovementioned burden.

Therefore, the repeated acts of elevating the tongue leads to the smooth act of deglutition at meals. Accordingly, the tongue muscle-strengthening device in the invention of this application is effective for the recovery and prevention of aspiration.

In general, bad teeth alignment is known as being attributed to the insufficient expansion of the maxilla. Since the tongue muscle-strengthening device in the embodiment(s) of the invention of this application is composed of the part of maxillary teeth contact and the part of palate contact, an appropriate force is applied to the maxillary teeth row and palatine bones when elevating the tongue, and the maxillary teeth row and the palate are expanded reasonably. Therefore, the maxillary dental arch is expanded, and the tongue muscle-strengthening device in the invention of this application is effective for the improvement of teeth alignment. Since the nasal cavities are also expanded concurrently, furthermore, the tongue muscle-strengthening device in the invention of this application is effective for the improvement of nasal disorders.

Furthermore, bad teeth alignment is known to be caused by the excessive occlusal contact of the maxilla and mandible, so-called teeth clenching, by an insufficient space between the maxilla and mandible at rest, or by teeth gnashing at the moments other than mastication and deglutition.

The tongue muscle-strengthening device in the invention of this application is effective for the improvement of teeth alignment through the stable suspension of the mandible to the skull due to the abovementioned lingual adhesion, namely, the production of a sufficient space between the maxilla and mandible at rest. Furthermore, stress is reduced by the suppression of the hyperfunction of the masticatory muscle group and tongue muscles in the cervical cortex motor area due to the abovementioned lingual adhesion, and teeth gnashing and teeth clenching decrease in frequency or disappear. Therefore, the tongue muscle-strengthening device in the embodiment(s) of the invention of this application is effective for the improvement of teeth alignment.

In general, the correct position of the lingual apex is in contact with the maxillary incisive papilla.

The tongue muscle-strengthening device in the invention of this application has the part of lingual apex contact and allows the learning of the correct position of the lingual apex.

Among dysarthrias, those in the row "ta"—voiceless alveolar plosions among alveolars and those in the row "ra"—alveolar approximants are observed frequently.

The tongue muscle-strengthening device in the invention of this application makes tongue muscles elevate against the abovementioned burden because it has the part of placing a burden on tongue muscles when performing the act of elevating the tongue and readily elevates tongue muscles through the repeated acts of elevating the tongue. Therefore, the tongue muscle-strengthening device in the embodiment(s) of the invention of this application is effective for the improvement and prevention of dysarthrias in the row "ta"—voiceless alveolar plosions among alveolars and in the row "ra"—alveolar approximants.

What is claimed is:

1. A tongue muscle-strengthening device comprising:

a U-shaped structure operable to contact maxillary teeth;

a contact structure that is provided within the U-shaped structure and is operable to being in contact with a dorsum of a tongue;

wherein the contact structure is connected to a middle part of the U-shaped structure and is separate from two straight end parts of the U-shaped structure, and wherein the contact structure is connected to the U-shaped structure so as to extend obliquely downward from a plane defined by the U-shape structure.

2. The tongue muscle-strengthening device according to claim 1, wherein the U-shaped structure includes:

a maxillary teeth tongue side contact part operable to contact a tongue side of the maxillary teeth;

a maxillary teeth occlusion contact part operable to contact an occlusion side of the maxillary teeth; and a maxillary teeth cheek side contact part operable to contact a cheek side of the maxillary teeth.

3. The tongue muscle-strengthening device according to claim 2, wherein the maxillary teeth contact part, the maxillary teeth tongue side contact part, the maxillary teeth occlusion contact part and the maxillary teeth cheek side contact part give a force to the maxillary dental arch in the maxillary teeth contact part when elevating tongue muscles.

4. The tongue muscle-strengthening device according to claim 1, wherein the contact structure comprises a tongue dorsum contact part operable to contact a dorsum of a tongue and a palate contact part operable to contact a palate, the palate contact part being located on the opposite side of the contact structure from the tongue dorsum contact part.

5. The tongue muscle-strengthening device according to claim 4, wherein the tongue dorsum contact part and the palate contact part give an expansive force to palatine bones when elevating tongue muscles.

6. The tongue muscle-strengthening device according to claim 1, wherein the contact structure has a lingual apex contact part in which a lingual apex is elevated at a site corresponding to a maxillary incisive papilla.

7. The tongue muscle-strengthening device according to claim 1, wherein the contact structure is convexed toward a palate.

8. A tongue muscle-strengthening device comprising:

a maxillary teeth contact part being in contact with maxillary teeth;

a connection part being elastic and connected to the maxillary teeth contact part; and a contact structure that is connected to the connection part, wherein the contact structure is movable toward a palate with respect to the maxillary teeth contact part from a first position in which the contact structure is substantially separated from the palate if the tongue is relaxed to a second position substantially displaced from the first position if the tongue is elevated, and wherein the maxillary teeth contact part has a U-shaped structure, the contact structure being accommodated within the U-shaped structure when viewed perpendicular to a plane defined by the U-shaped structure.

9. The tongue muscle-strengthening device according to claim 2, wherein the contact structure and the maxillary teeth tongue side contact part are configured to cover the entirety of a palate if the tongue is elevated.

10. The tongue muscle-strengthening device according to claim 1, wherein the contact structure is accommodated within the U-shaped structure when viewed perpendicular to the plane defined by the U-shape structure.

* * * * *